United States Patent [19]

Sharman

[11] Patent Number: 4,938,368

[45] Date of Patent: Jul. 3, 1990

[54] MERCHANDISE DISPLAY AND DISPENSER RACK

[75] Inventor: Brent O. Sharman, Penticton, Canada

[73] Assignee: Victor Ventures Ltd., Penticton, Canada

[21] Appl. No.: 360,533

[22] Filed: Jun. 2, 1989

[51] Int. Cl.[5] ..... A47F 7/00

[52] U.S. Cl. ..... 211/57.1; 211/71

[58] Field of Search ..... 211/57.1, 59.1, 71, 211/125, 113, 118, 13, 189

[56] References Cited

U.S. PATENT DOCUMENTS

| | | | |
|---|---|---|---|
| 1,093,856 | 4/1914 | Hurff | 211/113 X |
| 2,116,386 | 5/1938 | Copeland | 211/71 X |
| 2,547,531 | 4/1951 | Melvin et al. | 211/71 X |
| 2,630,923 | 3/1953 | Makar | 211/71 |
| 2,677,468 | 5/1954 | Dreyfus, Jr. | 211/71 |
| 2,868,385 | 1/1959 | Dreyfus, Jr. | 211/71 |
| 3,498,469 | 3/1970 | Hummel | 211/71 |
| 4,291,810 | 9/1981 | Rubenstein | 211/71 X |
| 4,461,387 | 7/1984 | Belokin, Jr. | 211/194 X |
| 4,546,943 | 10/1985 | Fast | 211/57.1 X |

*Primary Examiner*—Alvin C. Chin-Shue
*Assistant Examiner*—Sarah A. Lechok
*Attorney, Agent, or Firm*—Berman, Aisenberg & Platt

[57] ABSTRACT

A merchandise display and dispenser rack comprising a planar frame having a pair of spaced transverse members on which are releasably supported, in vertical orientation, a plurality of linear merchandise-supporting members. Each of these members is provided with a plurality of upwardly extending, outwardly protruding merchandise-receiving ears spaced along the length thereof. These racks may be arranged with appropriate numbers of vertically oriented merchandise-supporting members and appropriate amounts of merchandise for an efficient, eye-catching display.

7 Claims, 1 Drawing Sheet

MERCHANDISE DISPLAY AND DISPENSER RACK

FIELD OF THE INVENTION

The present invention relates to a merchandise display and dispenser rack, and more particularly to a rack for displaying and releasably supporting merchandise, particularly in bags or supported on cards.

BACKGROUND OF THE INVENTION

Merchandise display and dispenser racks of the general type in question, designed for displaying and dispensing bags or cards containing merchandise to be sold, are well known. For example, Canadian Patent No. 501,750 of Makar issued Apr. 20, 1954, describes and illustrates a rack for displaying bags of potato chips and the like. The bags are mounted by way of clips to a rigid, centrally positioned, inverted U-shaped frame. Other patents describing and illustrating construction of dispenser racks, of general background interest to the present invention, include U.S. Pat. No. 2,246,692 of Ohme issued July 24, 1941 and U.S. Pat. No. 3,172,539 of Rulf issued Mar. 9, 1965.

Canadian Patent No. 675,084 of Rose issued Dec. 3, 1963 is also of general background interest to the present invention, in that it describes a holding rack for hypodermic needles having a frame and moveable supports extends from end-to-end on the frame.

It is an object of the present invention to provide a merchandise display and dispensing rack which is economical to construct, and simple and effective in use.

It is a further object of the present invention to provide such a rack which is readily adaptable to different sized bags or cards of products to be displayed, and which both attractively displays such merchandise and takes up a minimum of space.

SUMMARY OF THE INVENTION

In accordance with the present invention there is provided a merchandise display and dispenser rack comprising a planar frame which incorporates a pair of spaced, transverse upper and lower members to be horizontally oriented when the rack is in position. A plurality of suspension means are spaced along the upper of the transverse members. A plurality of corresponding apertures are spaced along the lower of the transverse members. A plurality of linear, merchandise-supporting members are provided, each of which has at one end, means to releasably receive the suspension means and be supported thereon in vertical fashion when the rack is in position. The other end extends into the corresponding aperture of the lower transverse member when that merchandise-supporting member is supported on the suspension means. A plurality of upwardly extending, outwardly protruding merchandise-receiving ears are spaced along the length of each merchandise-supporting member to releasably receive merchandise in display and dispensing position.

In a preferred embodiment of the present invention, the linear merchandise-supporting members have U-shaped cross-sections and the ears are outwardly stamped from central portions thereof. As well the suspension means comprise nails secured to the upper transverse members. Each nail is bent forwardly so that its head portion is in horizontal orientation when the rack is in position. The linear merchandise support members are each provided at their upper ends with slot means to releasably receive one of the nail heads so that the linear merchandise support means is supported thereon against unpurposeful disengagement.

The display and dispenser rack according to the present invention is an inexpensive rack which is both versatile and effective in displaying merchandise of the type in question in stores and the like. One or more linear support members may be use, as required, enabling the merchandising of a wide variety of size products. The display rack, in use, occupies a minimum of space and provides reduced clutter for example in store aisles where it may be suspended from aisle shelves.

BRIEF DESCRIPTION OF THE INVENTION

These and other objects and advantages of the invention will become apparent upon reading the following detailed description and upon referring to the drawings in which.

Figure 1:
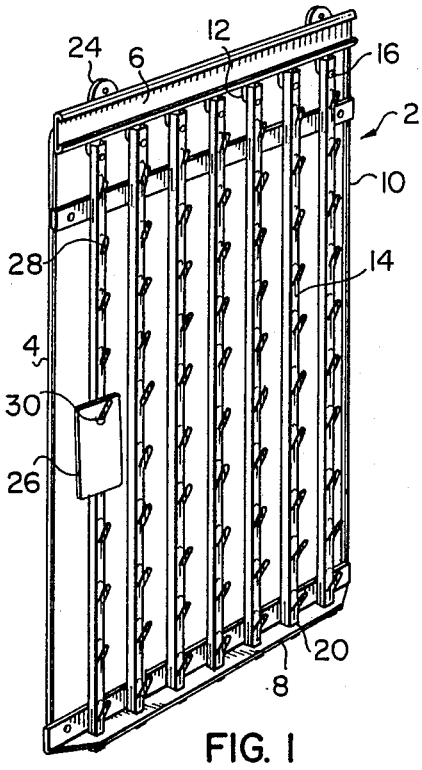
FIG. 1 is a perspective view from the front of a display and dispenser rack in accordance with the present invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Figure 2:
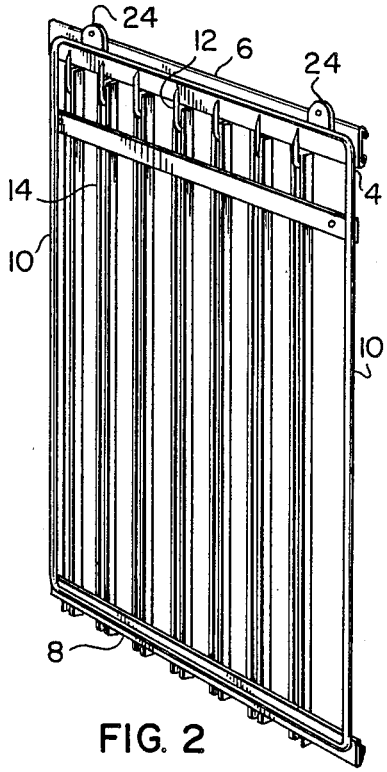
FIG. 2 is a perspective view from the rear of the rack of FIG. 1.

Turning to the drawings, there is illustrated in FIGS. 1 and 2, a merchandise display and dispenser rack 2 in accordance with the present invention. Rack 2 has a planar frame 4, of generally rectangular shape, formed from upper transverse member 6, lower transverse member 8 and side elongated longitudinal members 10 secured thereto and extending therebetween. These members are preferably made of rugged material such as metal or sturdy plastic.

Secured to upper transverse member 6, and equally spaced along its length are a plurality (in the illustrated embodiment, seven) of nails 12 forming suspension means for linear merchandise supporting members 14. Where the members are made of metal, nails 12 are welded or otherwise secured to member 6. They are bent so that their heads 16 and the nail portions adjacent thereto extend forwardly, in horizontal fashion, beneath upper member 6.

In lower member 8 are a plurality of apertures 20, each aligned with a corresponding nail 12. Apertures 20 are positioned and of a size and shape to releasably receive the lower portion of one of merchandise-supporting members 14 when it is releasably supported on the corresponding upper nail 12. A key hole slot 22 (FIG. 3) is provided near the upper end of merchandise supporting member 14 through which the head 16 of a nail releasably fits for releasably supporting member 14. The length of each member 14, of course, is such that when the member is supported on a nail 12, the lower end of member 14 extends through the corresponding aperture 20 in lower transverse member 8. In this manner, member 14 is immobilized. Rack 2 is intended to be supported in vertical position, for example on shelves in the aisle of a store and, for this purpose, appropriate securing means 24 are provided at appropriate positions on frame 4.

Figure 3:
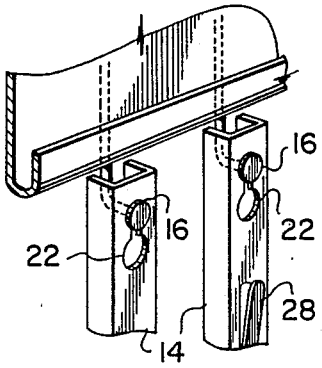
FIG. 3 is an enlarged partial view of an upper portion of the rack of FIG. 1.
Figure 4:
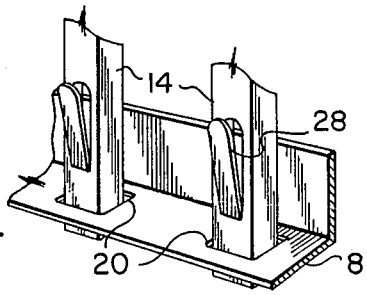
FIG. 4 is an enlarged partial view of a lower portion of the rack of FIG. 1.

For releasably supporting bags or cards 26 of merchandise to be displayed on rack 2, a plurality of upwardly extending, outwardly protruding ears 28 are spaced along the length of each member 14. An appropriate ear 28 simply hooks into an appropriate aperture 30 in the bag or card 26, that aperture being appropriately positioned, for example, by being centered in the upper portion of that bag or card. To facilitate this construction, while at the same time enhancing the rigidity and sturdiness of rack 2, members 14 are preferably made of sturdy metal or plastic material of U-shaped cross-section (FIGS. 3 or 4). With this construction, ears 28 may then be readily stamped from the bottom portion of members 14.

While the suspension means for members 14 have been illustrated as being nails 12, it will be understood that any appropriate protrusion while releasably securing thereon one of members 14 may be secured to and spaced along upper transverse member 6, within the scope of the present invention.

In operation, when a plurality or merchandise bags or cards 26 are releasably supported by means or ears 28 on vertical members 14, an attractive merchandise display, which takes up a minimum of space, is provided. Customers can readily remove bags from the display. The store owner can rearrange merchandise on the display as desired, and can put a single or a plurality of vertical members 14 in position on rack 2, depending on the size of the bags or cards to be displayed and the type of display desired. Thus, the rack is extremely versatile. As well, the construction of the rack, with plural vertical members 14 and the plurality of merchandise-receiving ears 28 enables great concentration of merchandise on a single rack 2, if desired, to reduce the need for re-stocking of the rack.

Thus it is apparent that there has been provided in accordance with the present invention a merchandise display and dispenser rack that fully satisfies the objects, aims and advantages set forth above. While the invention has been described in conjunction with a specific embodiment thereof, it is evident that many alternatives, modifications and variations will be apparent to those skilled in the art in light of the foregoing description. For example, while the rack has been illustrated as having securing means 24 to enable the rack to be secured for example to existing store shelving, it may alternatively be mounted on a conventional swivel, so that it can be placed on counters and the like. In addition, to add to the versatility of the rack according to the present invention, the individual linear merchandise supporting members 14 may be used on their own, for example by being releasably attached directly to store shelves or the like by an appropriate attachment means. Accordingly, it is intended to embrace all such alternatives, modifications and variations as fall within the spirit and broad scope of the invention.

What I claim as my invention:

1. A merchandise display and dispenser rack comprising a planar frame, which incorporates a pair of spaced, transverse upper and lower members to be horizontally oriented when the rack is in position, a plurality of suspension means spaced along the upper of the transverse members, a plurality of corresponding apertures spaced along the lower of the transverse members and a plurality of linear, merchandise-supporting members, each of which is provided, at one end, with means to releasably receive the suspension means and be supported thereon in vertical fashion when the rack is in position, the other end to extend into the corresponding aperture of the lower transverse member when that merchandise-supporting member is supported on the suspension means, a plurality of upwardly extending, outwardly protruding merchandise-receiving ears spaced along the length of each merchandise-supporting member to releasably receive merchandise in display and dispensing position.

2. A rack according to claim 1 wherein the linear merchandise-supporting members have U-shaped cross-sections and the ears are outwardly stamped from central portions thereof.

3. A rack according to claim 2 wherein the suspension means comprise nails secured to the upper transverse members, each nail bent forwardly so that its head portion is in horizontal orientation when the rack is in position.

4. A rack according to claim 3 wherein the linear merchandise-supporting members are each provided at said one end with slot means to releasably receive the bend portion one of said nails so that the linear merchandise-supporting member is supported thereon against unpurposeful disengagement.

5. A rack according to claim 1 for displaying and dispensing merchandise supported on cards or in bags, the ears being designed to releasably hook into holes centrally displaced in upper portions of the cards and bags for supporting the cards or bags thereon.

6. A rack according to claim 1 wherein the suspension means and corresponding apertures are equally spaced along their respective transverse members, corresponding suspension means and apertures being vertically aligned.

7. A rack according to claim 1 wherein means are secured to the frame for releasably attaching the frame to a support.

* * * * *